US009978504B2

(12) United States Patent
Narisawa et al.

(10) Patent No.: US 9,978,504 B2
(45) Date of Patent: May 22, 2018

(54) COIL DEVICE

(71) Applicant: TDK CORPORATION, Minato-ku, Tokyo (JP)

(72) Inventors: Yuuki Narisawa, Tokyo (JP); Nobuo Takagi, Tokyo (JP); Yuu Okabe, Tokyo (JP)

(73) Assignee: TDK CORPORATION, Tokyo (JP)

( * ) Notice: Subject to any disclaimer, the term of this patent is extended or adjusted under 35 U.S.C. 154(b) by 0 days. days.

(21) Appl. No.: 15/046,195

(22) Filed: Feb. 17, 2016

(65) Prior Publication Data

US 2016/0240303 A1 Aug. 18, 2016

(30) Foreign Application Priority Data

Feb. 18, 2015 (JP) ..... 2015-029737

(51) Int. Cl.

| | |
|---|---|
| ***H01F 17/04*** | (2006.01) |
| ***H01F 27/28*** | (2006.01) |
| ***H01F 27/29*** | (2006.01) |
| *H01F 27/32* | (2006.01) |

(52) U.S. Cl.

CPC ..... *H01F 27/2823* (2013.01); *H01F 17/04* (2013.01); *H01F 27/29* (2013.01); *H01F 27/327* (2013.01)

(58) Field of Classification Search

CPC ..... H01F 27/2823; H01F 27/29; H01F 27/24; H01F 27/327; H01F 27/292; H01F 17/04; H01F 17/045; H01F 2017/048

USPC ..... 336/192, 182, 222, 83, 220, 221

See application file for complete search history.

(56) References Cited

U.S. PATENT DOCUMENTS

| | | | | |
|---|---|---|---|---|
| 5,923,237 | A * | 7/1999 | Sato | H03H 7/42 336/192 |
| 2002/0021201 | A1* | 2/2002 | Oi | H01F 3/14 336/197 |
| 2011/0248810 | A1* | 10/2011 | Ukawa | H01F 5/04 336/192 |

FOREIGN PATENT DOCUMENTS

JP 2010-165953 A 7/2010

* cited by examiner

*Primary Examiner* — Mangtin Lian
(74) *Attorney, Agent, or Firm* — Arent Fox LLP

(57) ABSTRACT

A coil device includes a core (20) having a columnar shaft (22), a first winding part (42) and a second winding part (46) that are wound around the shaft, and a terminal part (52) connected with ends of the first winding part and ends of the second winding part. A partition portion (30) provided on an outer peripheral surface (22*a*) of the shaft of the core protrudes from the outer peripheral surface toward the outer diameter direction and divides a part of the first winding part and a part of the second winding part.

7 Claims, 4 Drawing Sheets

COIL DEVICE

BACKGROUND OF THE INVENTION

1. Field of the Invention

The present invention relates to a coil device with a plurality of winding parts wound around a core.

2. Description of the Related Art

There is a coil device with a plurality of winding parts, such as two winding parts, wound around a core. In such a coil device, a magnetic coupling between one winding part and the other winding part may be desired to be weakened for prevention of variation of inductor characteristics, for example.

As a coil device with two winding parts whose magnetic coupling is weakened, Patent Document 1 suggests a coil device with a core made of non-magnetic material and two winding parts formed to cross each other in each tern.

Patent Document 1: Japanese Unexamined Patent Application Publication No. 2010-165953

SUMMARY OF THE INVENTION

When the two winding parts are crossed each other in each turn, however, the coil device is hard to be downsized, because the core has a longer axial length due to increase of the number of turns of the winding parts. For a coupled inductor used as a driver of a DC-DC converter or so, the non-magnetic material core may not be able to satisfy characteristics required for the coil device.

The present invention has been achieved in consideration of the circumstances, and its object is to provide a coil device that is capable of weakening a magnetic coupling of two winding parts wound around a core and preventing variation of inductance characteristics and is advantageous for downsizing.

To achieve the object, the coil device of the present invention comprises:

a core having a columnar shaft;

a first winding part and a second winding part that are wound around the shaft; and a terminal part connected with ends of the first winding part and ends of the second winding part, wherein a partition portion provided on an outer peripheral surface of the shaft of the core protrudes from the outer peripheral surface toward the outer diameter direction and divides a part of the first winding part and a part of the second winding part.

In the coil device of the present invention, the partition portion is provided on the outer peripheral surface of the shaft. Thus, a part of the first winding part and a part of the second winding part are divided by the partition portion, which makes it possible to weaken a magnetic coupling between the first winding part and the second winding part and prevent variation of inductance. Also, the first winding part and the second winding part can be wound around the shaft multiple times and overlapped in the outer diameter direction, which makes it possible to restrain the axial length of the core and achieve downsizing.

Also, for example, the core may include a first flange and a second flange, the first flange may be connected with one end of the shaft and protrudes further toward the outer diameter direction than the outer peripheral surface, the second flange may be connected with the other end of the shaft and protrudes further toward the outer diameter direction than the outer peripheral surface, and an outer diameter directional end of the partition portion may be arranged closer to the outer peripheral surface of the shaft than outer diameter directional ends of the first flange and the second flange.

Also, for example, at least one of another part of the first winding part and another part of the second winding part may be arranged in the outer diameter direction of the partition portion.

The winding parts are partly arranged in the outer diameter direction of the partition portion, which makes it possible to further shorten the axial length of the core and achieve downsizing of the coil device. In this structure, the outer diameter directional end of the partition portion is arranged closer to the outer peripheral surface of the shaft than the outer diameter directional ends of the flanges, which prevents the winding parts from partly protruding outward further than the outer diameter directional ends of the flanges and prevents increase of a projected area in the axial direction of the coil device. As a result, downsizing can be achieved. Also, this coil device can restrain the length of the winding parts and its DC resistance. Further, the partition portion can be prevented from interrupting magnetic loop flowing from the first flange to the second flange through the outside of the first winding part and the second winding part.

Also, the partition portion may be part of the core.

The partition portion is part of the core, which can omit a step for attaching the partition portion to the core. Thus, this coil device is easy to be manufactured. Also, the winding parts and the core can be closely positioned, which can prevent leakage of magnetic flux toward outside and improve magnetic characteristics.

Also, for example, the partition portion may be continued in the outer peripheral direction of the shaft.

The partition portion has any shape and is continued in the outer peripheral direction. This allows the winding parts to be partly engaged with the partition portion in a more secure manner.

Also, for example, the coil device may further comprise an exterior resin configured to coat winding portions of the first winding part and the second winding part.

The exterior resin can protect the first winding part and the second winding part. Note that, the exterior resin may contain magnetic body, and that this exterior resin can prevent leakage of magnetic flux from the coil device toward outside and improve magnetic characteristics of the coil device.

DESCRIPTION OF THE PREFERRED EMBODIMENTS

Hereinafter, the present invention is explained based on an embodiment shown in the figures.

Figure 1:
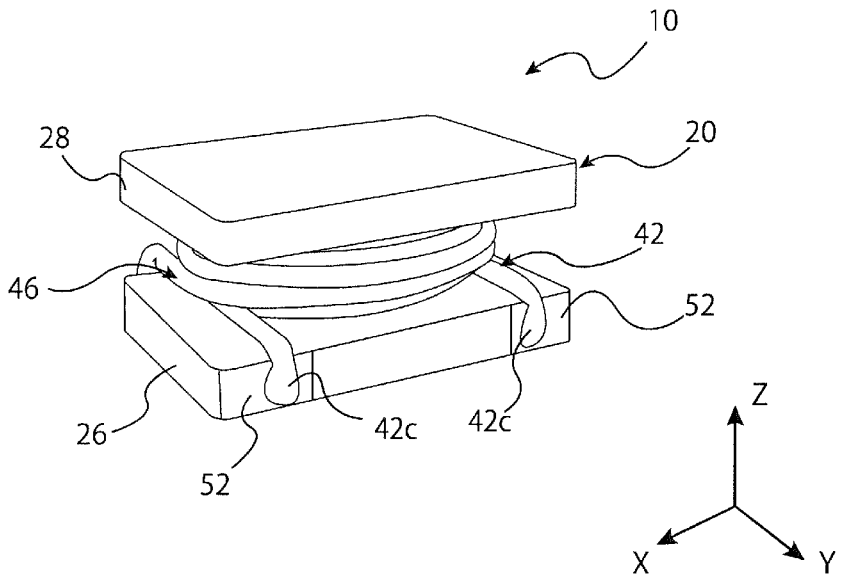
FIG. 1 is a perspective view of a coil device according to one embodiment of the present invention.

FIG. 1 is a perspective view of a coil device 10 according to one embodiment of the present invention. The coil device 10 has a core 20, a first winding part 42, a second winding part 46, and terminal parts 52. The coil device 10 has two winding parts of the first winding part 42 and the second winding part 46 formed around the core 20. However, the coil device 10 according to the present invention is not limited thereto, and other winding part, such as a third winding part and an auxiliary winding part, may be further formed around the core 20.

Figure 3:
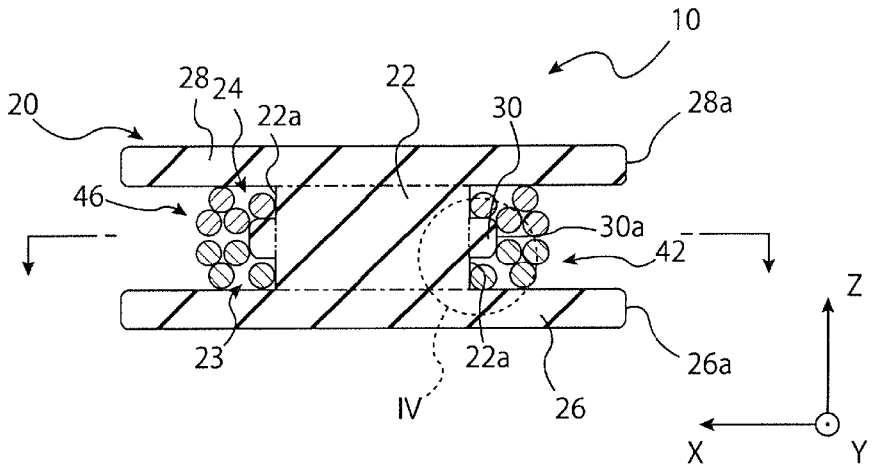
FIG. 3 is a vertical cross section of the coil device shown in FIG. 1.

As shown in FIG. 3 of a vertical cross section of the coil device 10, the core 20 has a columnar shaft 22, a first flange 26 connected with one end of the shaft 22, and a second flange 28 connected with the other end of the shaft 22. The first flange 26 and the second flange 28 protrude further toward the outer diameter direction than an outer peripheral surface 22*a* of the shaft 22.

The first winding part 42 and the second winding part 46 are wound around the shaft 22. A partition portion 30 is provided around the shaft 22 of the core 20. The partition portion 30 protrudes from the outer peripheral surface 22*a* of the shaft 22 toward the outer diameter direction and divides a part of the first winding part 42 and a part of the second winding part 46. In this embodiment, the partition portion 30 is part of the core 20 and integrally formed with shaft 22 and the flanges 26 and 28. Since the partition portion 30 is integrated with the core 20, a step for attaching a partition portion to a core is not needed in manufacturing steps of the coil 10, and thus this coil device 10 is easy to be manufactured. Also, the winding parts 42 and 46 and the core 20 can be closely positioned, which can prevent leakage of magnetic flux toward outside and improve magnetic characteristics. Note that, the partition portion 30 will be mentioned in detail below.

In explanation of the coil device 10, an axial direction of the shaft 22 is defined as the Z-axis direction, and directions perpendicular to the Z-axis direction are defined as the X-axis direction and the Y-axis direction. Also, a direction that is parallel to the XY plane and extends from a central axis C of the shaft 22 (see FIG. 6) toward a radial direction is defined as an outer diameter direction of the coil device 10.

Figure 6:
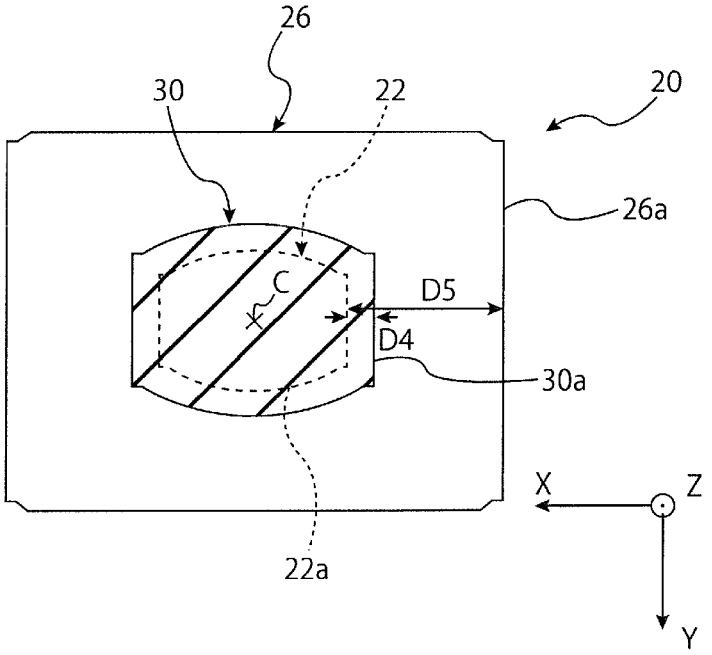
FIG. 6 is a horizontal cross section of the core included in the coil device shown in FIG. 1.

As shown in FIG. 6 of a horizontal cross section of the core 20, the shaft 22 has a horizontal cross sectional shape with straight sides in the Y-axis direction and partly arc-shaped sides in the X-axis direction and has a columnar shape extending in the Z-axis direction. Note that, the shaft 22 has any shape and may have a column shape, an elliptical column shape, a prism shape, or any other shape.

The first flange 26 is connected with an end of the core 20 at the negative side of the Z-axis direction, and the second flange 28 is connected with an end of the core 20 at the positive side of the Z-axis direction. The first flange 26 and the second flange 28 protrude further toward the outer diameter direction than the outer peripheral surface 22*a* of the shaft 22 and have a rectangular plate shape with slits at four corners. However, the first flange 26 and the second flange 28 are not limited to have the shape, and may have a polygonal plate shape, a disc shape, an elliptic-plate shape, or any other shape that is larger than an outer diameter of the outer peripheral surface 22*a* of the shaft 22.

The first flange 26 and the second flange 28 do not necessarily have the same shape, but have the same shape in this embodiment. Also, the core 20 and the coil device 10 have any size, but the length (X-axis direction) is 0.2 to 20 mm, the width (Y-axis direction) is 0.2 to 20 mm, and the height (Z-axis direction) is 0.1 to 10 mm.

The core 20 is made of any material, but the core 20 in this embodiment is a magnetic body core. For example, the core 20 is manufactured by performing pressure molding or so to ferrite particles or metal particles, such as Fe—Ni alloy powder, Fe—Si alloy powder, Fe—Si—Cr alloy powder, Fe—Si—Al alloy powder, permalloy powder, amorphous powder, and Fe powder. In case of using the coil device 10 for driving a DC-DC converter, as the core 20, it is possible to favorably employ a magnetic body core containing metal particles, especially ones with insulating film, such as silicon based oxide film, metal oxide film, and glass film, from a viewpoint of prevention of magnetic saturation even if a large current is flowing to the winding parts 42 and 46. Also, the core 20 is manufactured by any method. For example, the core 20 is obtained by firing a core molded body of injection molding, extrusion molding, lamination molding, transfer molding etc. at 600 to 1100° C.

Figure 2:
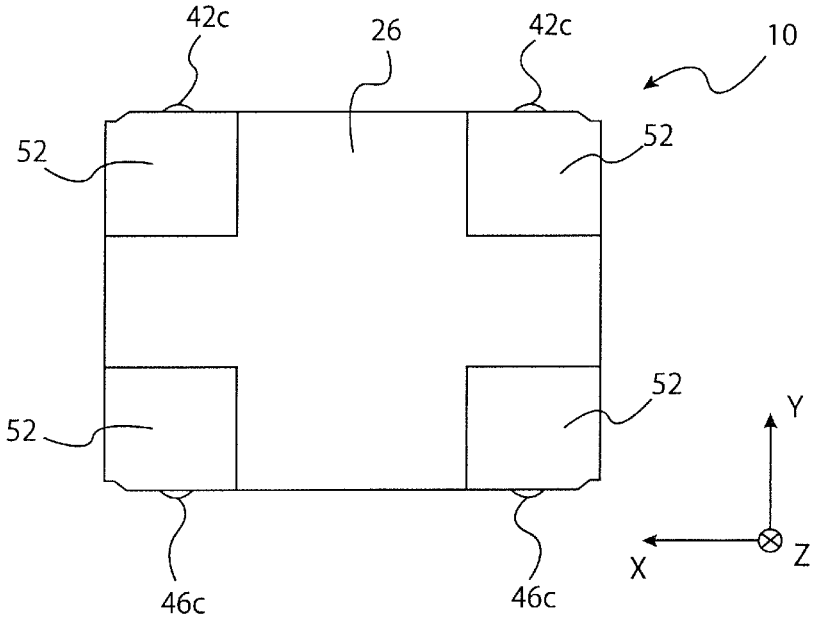
FIG. 2 is a bottom view of the coil device shown in FIG. 1.

As shown in FIG. 1 and FIG. 2, ends 42*c* of the first winding part 42 and ends 46*c* of the second winding part 46 are connected with the terminal parts 52 provided at four corners of the first flange 26. As shown in FIG. 2, the terminal parts 52 are provided at the four corners of the first flange 26. Each of the terminal parts 52 is formed to be continued from first flange ends 26*a* at the side of the outer diameter of the first flange 26 to a rear surface (a surface at the negative side of the Z-axis direction) of the first flange 26. Each of the terminal parts 52 is arranged with a predetermined space therebetween to be mutually insulated.

The ends 42*c* and 46*c* of the first winding part 42 and the second winding part 46 are connected with areas on the first flange ends 26*a* of the terminal parts 52 by laser welding, resistance welding, soldering, etc. The first winding part 42 and the second winding part 46 are any coated wire with a conductor coated by an insulator. This conductor may be made by one wire (single wire) or by bundling multiple wires, such as stranded wire, and may be made of copper, silver, gold, alloy of these metals etc. Also, the first winding part 42 and the second winding part 46 may be wound around the shaft 22 by edgewise winding or crosswise winding.

The terminal parts 52 are made of any material and formed by any method. For example, the terminal parts 52 can be formed by depositing a desired plating film on the surface of the core 20 with electroplating or electroless plating. Also, the plating film of the terminal parts 52 may be a single layer or multiple layers, and may be Ni—Sn plating, Cu—Ni—Sn plating, Sn plating, Ni—Au plating, Au plating etc. The terminal parts 52 have any thickness, but preferably has a thickness of 0.1 to 15 μm.

As shown in FIG. 3, the partition portion 30 is arranged at the middle of the Z-axis direction of the shaft 22 of the core 20. The partition portion 30 protrudes further in the outer diameter direction than the outer peripheral surface 22*a* of the shaft 22. Thus, a first concave section 23 positioned between the first flange part 26 and the partition portion 30 in the Z-axis direction and a second concave section 24 positioned between the second flange part 28 and the partition portion 30 in the Z-axis direction are formed at the side of the outer diameter of the outer peripheral surface 22*a*.

Figure 4:
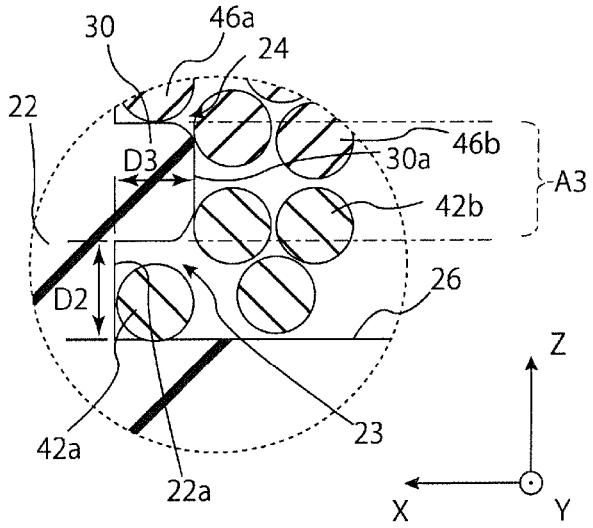
FIG. 4 is an enlarged cross section of a part of FIG. 3.

As shown in FIG. 4 of a partially enlarged figure of FIG. 3, a first part 42*a* is part of the first winding part 42 and arranged in the first concave section 23 at the side of the first flange part 26 to the partition portion 30, and a second part 46*a* is part of the second winding part 46 and arranged in the second concave section 24 at the side of the partition portion 30 to the second flange part 28. In this way, the partition portion 30 divides the first part 42*a* of the first winding part 42 and the second part 46*a* of the second winding part 46 into the side of the first flange 26 and the side of the second flange 28.

As shown in FIG. 3, a partition portion end 30*a* of an outer diameter directional end of the partition portion 30 is arranged closer to the outer peripheral surface 22*a* of the shaft 22 than the first flange end 26*a* of an outer diameter directional end of the first flange 26 and the second flange end 28*a* of an outer diameter directional end of the second flange 28. As shown in FIG. 6 of a horizontal cross section of the core 20, from a viewpoint of downsizing of the coil device 10 while dividing the first part 42*a* of the first winding part 42 and the second part 46*a* of the second winding part 46, a distance D4 from the partition portion end 30*a* to the outer peripheral surface 22*a* is preferably 1 to 90% of a distance D5 from the first flange end 26*a* and the second flange end 28*a* to the outer peripheral surface 22*a* in the same outer diameter direction. Also, the partition portion end 30*a* is arranged closer to the outer peripheral surface 22*a* than the first flange end 26*a* and the second flange end 28*a*, which can prevent the partition portion 30 from interrupting magnetic loop flowing from the first flange end 26*a* to the second flange end 28*a* through the outside of the first winding part 42 and the second winding part 46.

Figure 5:
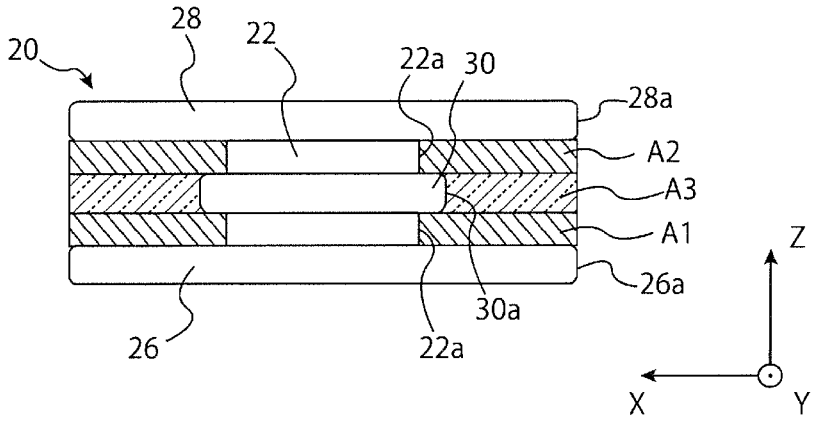
FIG. 5 is a conceptual view for explaining regions around a shaft and a partition portion of a core.

Note that, the partition portion end 30*a* may be arranged at the same position as the first flange end 26*a* or the second flange end 28*a*. In this variation, the partition portion 30 divides the whole winding portion of the first winding part 42 and the whole winding portion of the second winding part 46 into the side of the first flange 26 and the side of the second flange 28. In the core 20 of this embodiment, however, since the partition portion end 30*a* is arranged closer to the outer peripheral surface 22*a* of the shaft 22 than the first flange end 26*a* and the second flange end 28*a*, the space between the first flange 26 and the second flange 28 is divided into the following three regions along the Z-axis direction, as shown in FIG. 5. That is, the space sandwiched by the first flange 26 and the second flange 28 in the Z-axis direction can be divided into a middle region A3, a first region A1, and a second region A2. The middle region A3 is located in the outer diameter direction of the partition portion 30. The first region A1 is located closer to the first flange 26 than the middle region A3 is. The second region A2 is located closer to the second flange 28 than the middle region A3 is.

As shown in FIG. 3 and FIG. 4, the coil device 10 has some part of the first winding part 42 and the second winding part 46 that cannot be contained in the first concave section 23 or the second concave section 24, because the number of turns of the first winding part 42 and the second winding part 46 wound around the shaft 22 of core 20 exceeds one turn and further increases. In the coil device 10 of this embodiment, a third part 42*b* and a fourth part 46*b* are arranged in the middle region A3 in the outer diameter direction of the partition portion 30 (see FIG. 5). The third part 42*b* is part of the first winding part 42 and different from the first part 42*a*, and the fourth part 46*b* is part of the second winding part 46 and different from the second part 46*a*.

In this way, the partition portion 30 does not divide the whole winding portion of the first winding part 42 or the whole winding portion of the second winding part 46, and there is a part arranged in a region (middle region A3) in the outer diameter direction of the partition portion 30, such as the third part 42*b* of the first winding part 42 and the fourth part 46*b* of the second winding part 46. Thus, a height D1 (a length in the Z-axis direction) of the coil device 10 can be restrained. Also, compared with an embodiment where the partition portion 30 divides the whole winding portion of the first winding part 42 and the whole winding portion of the second winding part 46, the coil device 10 can improve winding density in the space between the first flange 26 and the second flange 28 and shorten the length of the first winding part 42 and the second winding part 46 to restrain DC resistance. Further, the partition portion 30 is shortened and arranged inside the first winding part 42 and the second winding part 46, which can prevent the partition portion 30 from interrupting magnetic loop flowing from the first flange end 26*a* to the second flange end 28*a* through the outside of the first winding part 42 and the second winding part 46.

From a viewpoint of weakening magnetic coupling between the first winding part 42 and the second winding part 46, as the coil device 10 of this embodiment, the first winding part 42 preferably has its winding portion arranged in the middle region A3 and the first region A1 shown in FIG. 5, and the second winding part 46 preferably has its winding portion arranged in the middle region A3 and the second region A2 shown in FIG. 5. Note that, the first winding part 42 may have its winding portion partially arranged in the second region A2, and the second winding part 46 may have its winding portion partially arranged in the first region A1. Even in this case, due to influence of portions engaged with the first concave section 23 and the second concave section 24, the first winding part 42 is eccentrically arranged at the side of the first flange 26 to the middle in the Z-axis direction, and the second winding part 46 is eccentrically arranged at the side of the second flange 28 to the middle in the Z-axis direction. As a result, the magnetic coupling between the first winding part 42 and the second winding part 46 is weakened, compared with a case of no partition portion 30.

As shown in FIG. 4, a distance D2 (a width in the Z-axis direction of the first concave section 23) from the partition portion 30 to the first flange 26 is preferably 1.0 to 10 times as long as a diameter of the first winding part 42 from a viewpoint of securely engaging the first part 42*a* of the first winding part 42 with the first concave section 23 and securely divide the first part 42*a* and the second part 46*a*. Also, a distance D3 (a depth in the outer diameter direction of the first concave section 23) from the partition portion end 30*a* at the side of the outer diameter direction of the partition portion 30 to the outer peripheral surface 22*a* is preferably 0.5 to 30 times as long as a diameter of the first winding part 42 from a viewpoint of restraining a winding diameter of the second part 46*a* of the first winding part 42 and a total length of the first winding part 42 while securely engaging the first part 42*a* of the first winding part 42 with the first concave section 23.

Note that, a dimensional relation between a distance (a width in the Z-axis direction of the second concave section 24) from the partition portion 30 to the second flange 28 or a depth in the outer diameter direction of the second concave section 24 and a diameter of the second winding part 46 is preferably the same as a dimensional relation between the first concave section 23 and a diameter of the first winding part 42 mentioned above.

For example, the coil device 10 shown in FIG. 1 is manufactured as below. The core 20 is manufactured by pressure molding metal powder and firing it, the terminal parts 52 are formed by performing electroplating or electroless plating to the first flange 26 of the core 20, the first winding part 42 and the second winding part 46 are formed around the shaft 22 of the core 20 using an automatic winding machine or so, and the ends 42*c* and 46*c* of the first winding part 42 and the second winding part 46 are connected with the terminal parts 52. Although not illustrated in FIG. 1, if necessary, an exterior resin configured to coat the winding portions of the first winding part 42 and the second winding part 46 may be formed by discharging molten resin containing a magnetic body using a dispenser.

In a winding step included in the above-mentioned manufacturing step, the first winding part 42 and the second winding part 46 are formed as below. That is, a part of an electric wire for the first winding part 42 and the second winding part 46 is arranged around each of the first concave section 23 and the second concave section 24 of the core 20, and then either ends of the first winding part 42 and the second winding part 46 are wound around the outer peripheral surface 22*a* or the core 20 is rotated. The part of the first winding part 42 and the second winding part 46 is engaged with the partition portion 30, and the other part of the first winding part 42 and the second winding part 46 is subsequently wound around the shaft 22, so that the first winding part 42 and the second winding part 46 are formed. The first winding part 42 is eccentrically arranged at the side of the first flange 26 to the middle in the Z-axis direction, and the second winding part 46 is eccentrically arranged at the side of the second flange 28 to the middle in the Z-axis direction. The first winding part 42 and the second winding part 46 are partly engaged with the partition portion 30, which prevents manufacturing variation of arrangement of the first winding part 42 and the second winding part 46. Note that, either of the first winding part 42 and the second winding part 46 may be previously formed, or the first winding part 42 and the second winding part 46 may be formed at the same time.

In the coil device 10 of this embodiment, the first winding part 42 and the second winding part 46 are partly divided by the partition portion 30, which eccentrically arranges the first winding part 42 at the side of the first flange 26 to the middle in the Z-axis direction and the second winding part 46 at the side of the second flange 28 to the middle in the Z-axis direction. The coil device 10 can thus weaken the magnetic coupling between the first winding part 42 and the second winding part 46 and prevent variation of inductance. Also, the coil device 10 allows the first winding part 42 and the second winding part 46 to be wound around the shaft 22 multiple times and overlapped in the outer diameter direction thereof, which makes it possible to restrain the axial length of the core 20 and achieve downsizing. In particular, the partition portion end 30*a* in the outer diameter direction of the partition portion 30 is arranged closer to the outer peripheral surface 22*a* of the shaft 22 than the first flange end 26*a* and the second flange end 28*a*, which can increase winding density of the winding portion and effectively reduce the height D1 of the coil device, compared with a case that the partition portion 30 extends to the same position as the flange ends 26*a* and 28*a*.

From a viewpoint of dividing part of the first winding part 42 and part of the second winding part 46, the partition portion 30 is not necessarily continued in the outer peripheral direction of the shaft 22 and may be formed intermittently around the shaft 22. As shown in this embodiment, however, the partition portion 30 continued in the outer peripheral portion of the shaft 22 is preferable because the first winding part 42 and the second winding part 46 can be partly arranged in the first concave section 23 and the second concave section 24 in a secure manner.

Figure 7:
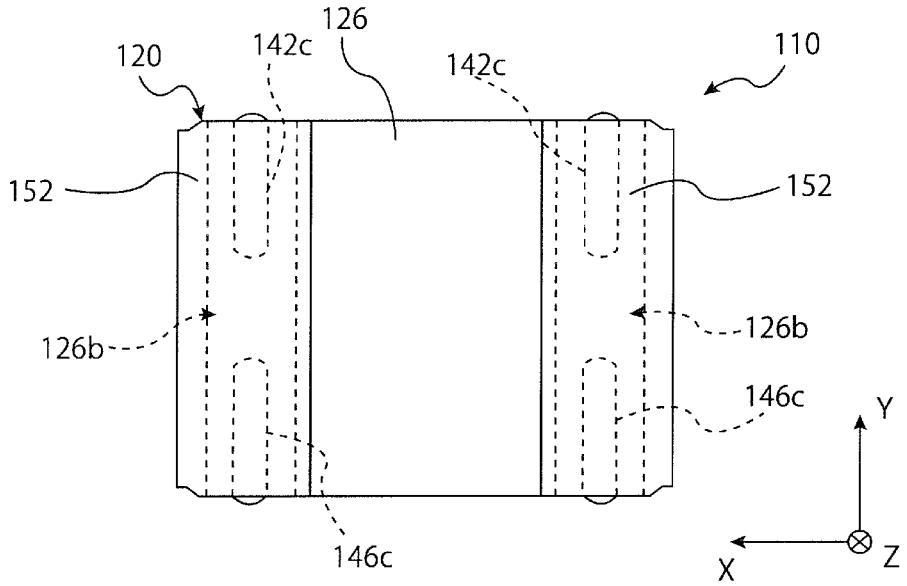
FIG. 7 is a bottom view of a coil device according to a first variation.

As shown above, the present invention is explained with reference to the embodiment, but is not limited thereto. Each component shown in the embodiment can be variously changed. FIG. 7 is a bottom view of a coil device 110 according to a first variation. The coil device 110 is different from the above-mentioned coil device 10 in bottom shape of a first flange 126 of a core 120, shape of terminal parts 152 provided with the first flange 126, and connection position between winding parts and the terminal parts 152.

As shown in FIG. 7, grooves 126*b* extending in the Y-axis direction are formed on the bottom surface of the first flange 126 of the core 120 at both sides in the X-axis direction. Ends 142*c* and 146*c* of a first winding part and a second winding part are inserted in each of the grooves 126*b*. The terminal parts 152 of the coil device 110 are provided on the bottom surface of the first flange part 126 at both sides in the X-axis direction. The terminal parts 152 are made of solder formed to fill the grooves 126*b*. The terminal parts 152 cover the surfaces of the ends 142*c* and 146*c* of the first winding part and the second winding part, and function as fixing the ends 142*c* and 146*c* of the first winding part and the second winding part to the core 120.

As understood from the comparison between the coil device 10 shown in FIG. 2 and the coil device 110 shown in FIG. 7, the terminal parts 52 and 152 have shape and arrangement that can be properly changed based on usage of the coil devices 10 and 110 or a substrate on which the coil devices 10 and 110 are mounted. Also, the coil device of the present invention may be one, such as the coil device 10, with a first winding part and a second winding part that are insulated each other, or may be one, such as the coil device 110, with a first winding part and a second winding part that are conductive each other via a terminal part or a substrate.

In the coil devices 10 and 110, the first winding part and the second winding part that are wound around the cores 20 and 120 may have the same or opposite directional polarity or winding direction. Note that, the coil device 110 has the same components as the coil device 10 shown in FIG. 1 etc. except for ones explained with FIG. 7 and demonstrates the same effects as the coil device 10.

Figure 8:
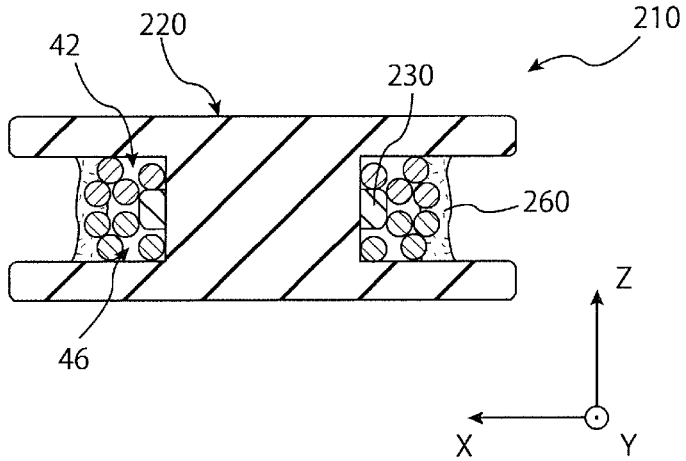
FIG. 8 is a cross section of a coil device according to a second variation.

FIG. 8 is a vertical bottom view of a coil device 210 according to a second variation. The coil device 210 is different from the coil device 10 shown in FIG. 3 in that a partition portion 230 and a core 220 are separated and that there is an exterior resin 260 configured to coat winding portions of a first winding part 42 and a second winding part 46, but is the same as the coil device 10 except for these respects and demonstrates the same effects as the coil device 10.

The partition portion 230 is arranged by fixing a separately molded member on an outer peripheral surface of a shaft of the core 220 or attaching a member with fluidity, such as molten resin, on the outer peripheral surface of the shaft. As is the case with the core 220, the partition portion 230 may be made of a magnetic body, such as metal and ferrite, resin containing magnetic body powder, or a non-magnetic body like a resin.

The exterior resin 260 may be one containing magnetic body powder, such as metal and ferrite, or may be one containing no magnetic body. The exterior resin 260 functions as protecting the first winding part 42 and the second winding part 46, and the exterior resin 260 containing a magnetic body can prevent leakage of magnetic flux from the coil device 210 toward the outside and improve magnetic characteristics of the coil device 210.

NUMERICAL REFERENCES

10, 110, 210 . . . coil device
22 . . . shaft
20, 120, 220 . . . core

22*a* . . . outer peripheral surface
26 . . . first flange
26*a* . . . first flange end
28 . . . second flange
28*a* . . . second flange end
30, 230 . . . partition portion
30*a* . . . partition portion end
A3 . . . middle region
42 . . . first winding part
42*a* . . . first part
42*b* . . . third part
46 . . . second winding part
42*c*, 142*c*, 46*c*, 146*c* . . . ends
46*a* . . . second part
46*b* . . . fourth part
52, 152 . . . terminal part
260 . . . exterior resin

The invention claimed is:

1. A coil device comprising:
a core having a columnar shaft;
a first winding part and a second winding part that are wound around the shaft; and
a terminal part connected with ends of the first winding part and ends of the second winding part, wherein:
a partition portion provided on an outer peripheral surface of the shaft of the core protrudes from the outer peripheral surface toward an outer diameter direction and divides a part of the first winding part and a part of the second winding part, and
the first winding part and the second winding part are wound on the partition portion in a circumferential direction of the partition portion with one or more turns.

2. The coil device as set forth in claim 1, wherein
the core includes a first flange and a second flange,
the first flange is connected with one end of the shaft and protrudes further toward the outer diameter direction than the outer peripheral surface,
the second flange is connected with the other end of the shaft and protrudes further toward the outer diameter direction than the outer peripheral surface, and
an outer diameter directional end of the partition portion is arranged closer to the outer peripheral surface of the shaft than outer diameter directional ends of the first flange and the second flange.

3. The coil device as set forth in claim 1, wherein
the partition portion is part of the core.

4. The coil device as set forth in claim 1, wherein
the partition portion is continued in the outer peripheral direction of the shaft.

5. The coil device as set forth in claim 1, further comprising:
an exterior resin configured to coat winding portions of the first winding part and the second winding part.

6. A coil device comprising:
a core having a columnar shaft;
a first winding part and a second winding part that are wound around the shaft; and
a terminal part connected with ends of the first winding part and ends of the second winding part, wherein
a partition portion provided on an outer peripheral surface of the shaft of the core protrudes from the outer peripheral surface toward an outer diameter direction and divides a part of the first winding part and a part of the second winding part,
the core includes a first flange and a second flange,
the first flange is connected with one end of the shaft and protrudes further toward the outer diameter direction than the outer peripheral surface,
the second flange is connected with the other end of the shaft and protrudes further toward the outer diameter direction than the outer peripheral surface,
a middle region located in the outer diameter direction of the partition portion is formed in a space sandwiched by the first flange and the second flange in a Z-axis direction,
a winding portion of the first winding part and the second winding part is arranged in the middle region, and
the first winding part and the second winding part are wound on the partition portion in a circumferential direction of the partition portion with one or more turns.

7. A coil device comprising:
a core having a columnar shaft;
a first winding part and a second winding part that are wound around the shaft; and
a terminal part connected with ends of the first winding part and ends of the second winding part, wherein
a partition portion provided on an outer peripheral surface of the shaft of the core protrudes from the outer peripheral surface toward an outer diameter direction and divides a part of the first winding part and a part of the second winding part,
the core includes a first flange and a second flange,
the first flange is connected with one end of the shaft and protrudes further toward the outer diameter direction than the outer peripheral surface,
the second flange is connected with the other end of the shaft and protrudes further toward the outer diameter direction than the outer peripheral surface,
a distance from the partition portion to the first flange is preferably 1.0 to 10 times as long as a diameter of the first winding part,
a distance from the partition portion end at the side of the outer diameter direction of the partition portion to the outer peripheral surface is 0.5 to 30 times as long as a diameter of a wire of the first winding part, and
the first winding part and the second winding part are wound on the partition portion in a circumferential direction of the partition portion with one or more turns.

* * * * *